US005487471A

United States Patent [19]

Marchek et al.

[11] Patent Number: 5,487,471

[45] Date of Patent: Jan. 30, 1996

[54] PACKAGING CONTAINER ASSEMBLY FOR ELECTRICAL CONNECTOR COMPONENTS

[75] Inventors: Kyle J. Marchek, Lisle; Timothy R. McClelland, Bolingbrook, both of Ill.

[73] Assignee: Molex Incorporated, Lisle, Ill.

[21] Appl. No.: 325,764

[22] Filed: Oct. 19, 1994

[51] Int. Cl.[6] ..... B65D 85/38; B65D 85/62

[52] U.S. Cl. ..... 206/725; 206/386; 206/499

[58] Field of Search ..... 206/328, 332, 206/334, 386, 499, 597, 600, 725

[56] References Cited

U.S. PATENT DOCUMENTS

| | | | |
|---|---|---|---|
| 2,534,011 | 12/1950 | Frye | 206/597 |
| 3,289,828 | 12/1966 | Dick et al. | 206/597 |
| 4,030,600 | 6/1977 | Heaps | 206/597 |
| 4,454,946 | 6/1984 | Yokowo | 229/120.3 |
| 4,877,137 | 10/1989 | Govang et al. | 206/597 |
| 5,251,753 | 10/1993 | Pigott et al. | 206/386 |
| 5,297,680 | 3/1994 | Butterfield et al. | 206/597 |
| 5,337,893 | 8/1994 | Nami et al. | 206/329 |
| 5,370,225 | 12/1994 | Corey et al. | 206/328 |
| 5,415,286 | 5/1995 | Marchek et al. | 206/334 |

*Primary Examiner*—Jimmy G. Foster
*Attorney, Agent, or Firm*—A. A. Tirva

[57] ABSTRACT

A packaging container assembly is provided for electrical connector components. The assembly includes a pallet and a tray alignment plate positionable onto the pallet. At least one tray is positionable onto the alignment plate and includes receptacles for supporting electrical connector components in a given orientation. Complementary interengaging alignment elements are provided between the tray and the alignment plate for assuring proper alignment of the tray relative to the alignment plate and, thereby, assuring proper orientation of the electrical connector components within the assembly.

7 Claims, 6 Drawing Sheets

PACKAGING CONTAINER ASSEMBLY FOR ELECTRICAL CONNECTOR COMPONENTS

FIELD OF THE INVENTION

This invention generally relates to the art of handling electrical connector components and, particularly, to a packaging container assembly for such components.

BACKGROUND OF THE INVENTION

The degree of automated handling, feeding and terminating electrical connectors has been ever-increasing in the connector industry to reduce labor costs and to increase speed and reliability of manufacture. However, with a corresponding ever-increasing trend toward miniaturization, difficulties continue to be encountered in handling large numbers of individual electrical connectors or connector components. Automatization, itself, has increased the problems of shipping, storing and automatically handling of such components. Many electrical connectors are manufactured/assembled in stages. Components may be produced, shipped and stored in intermediate assembly stages, and then the components are oriented and fed to automatic or partly automatic terminating machines. Fully assembled electrical connectors then are shipped and stored for ultimate use.

One arrangement for handling electrical connector assemblies or electrical connector components is a high density tray or magazine fabricated of a sheet of formed plastic material. For instance, a thin sheet of polyvinyl chloride is thermal formed or vacuum formed to provide a high density tray for electrical connectors. These types of trays typically include parallel rows of channels or troughs within which the connector components are arranged in end-to-end arrays. The components then can be fed seriatim individually from the individual rows.

The high density trays or magazines often are packaged and shipped in stacked arrays of trays within a packaging container assembly. In essence, present methods for packaging and shipping the connector components include: (1) placing the components into the trays; (2) stacking the trays into cartons; (3) placing the cartons onto a pallet; and (4) wrapping the cartons and the pallet for shipment. When the pallets arrive at a destination point, the procedure is reversed, and the wraps are taken off and the cartons are taken off the pallet. Eventually, the trays are manually removed from the cartons (e.g. cardboard boxes) and placed where they can be accessed by automated machinery (e.g. robot arms) for further processing. Although automated assembly of electrical connectors has reduced labor costs and increased speed and reliability of manufacture, these handling processes are time consuming and labor intensive. For high volume assemblies, the time and the additional labor expense may be substantial.

The present invention is directed to improvements in packaging container assemblies to reduce some of the problems involved in handling electrical connector components for automated processing. The invention is particularly directed to improvements for assuring proper orientation of the electrical connector components within the packaging container assembly.

SUMMARY OF THE INVENTION

An object, therefore, of the invention is to provide a new and improved packaging container assembly of the character described, for containing and properly orienting electrical connector components.

In the exemplary embodiment of the invention, the packaging container assembly includes a pallet and a tray alignment plate positionable onto the pallet. At least one tray is positionable onto the alignment plate and includes means for supporting electrical connector components in a given orientation. Complementary interengaging alignment means are provided between the tray and the alignment plate for assuring proper alignment of the tray relative to the alignment plate and, thereby, assuring proper orientation of the electrical connector components within the assembly.

As disclosed in the preferred embodiments, the pallet includes a generally planar top wall, and the tray alignment plate is formed as a sheet-like member for positioning onto the top wall. Generally, the alignment means is provided by raised ribs on the sheet-like member for engaging complementary alignment means on the tray only when the tray is properly aligned.

In one embodiment of the invention, the alignment ribs are located at an edge of the sheet-like alignment plate, and the alignment means on the tray are located at the periphery thereof. In a second embodiment of the invention, the slots are provided in the sheet-like alignment plate, and the alignment means on the tray are positioned in the slots.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 8:
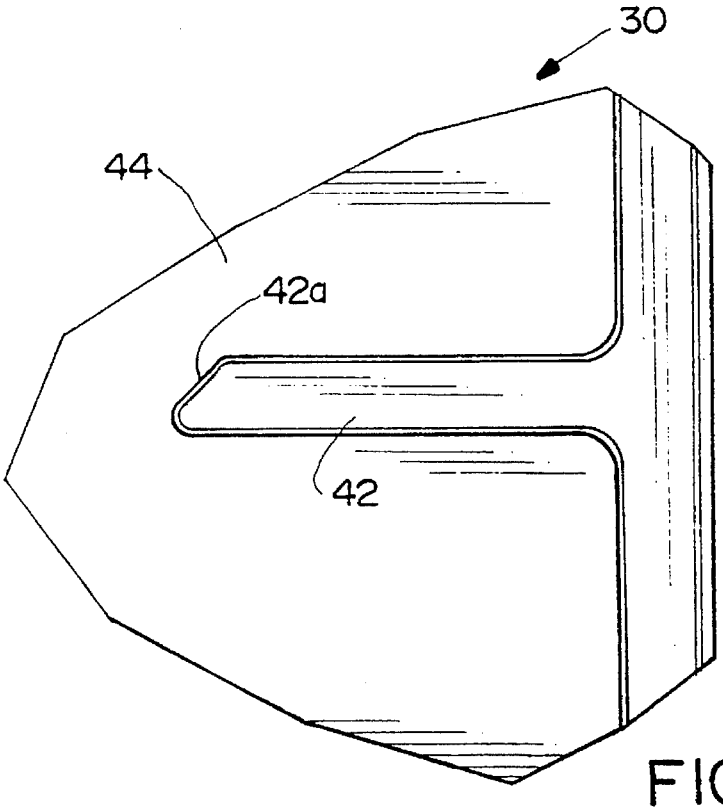
FIG. 8 is an enlarged fragmented view of the alignment rib at the mid-point of the right-hand edge of the tray in FIG. 5.
Figure 9:
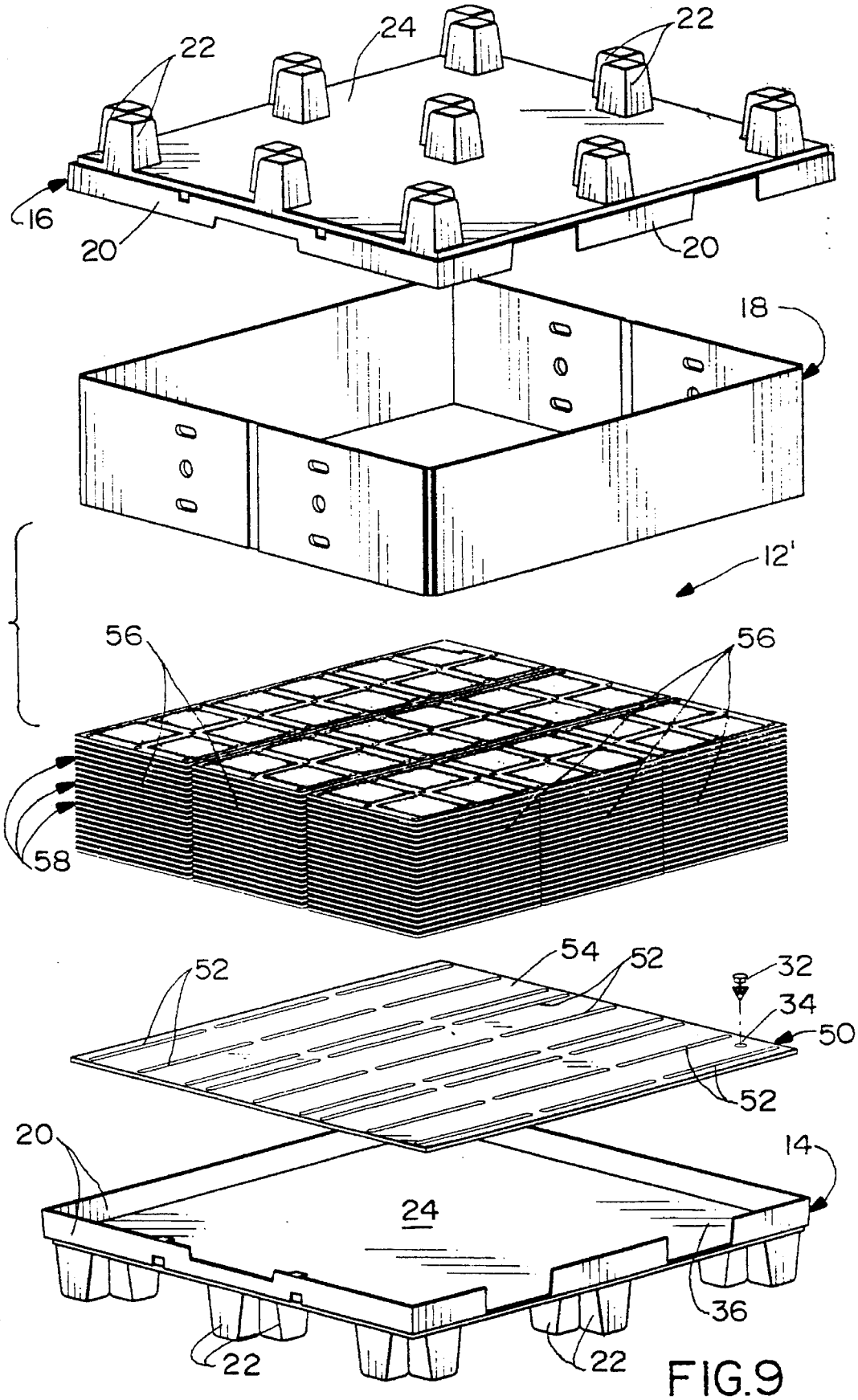
FIG. 9 is an exploded perspective view similar to that of FIG. 1, but of an alternate embodiment of the invention.
Figure 10:
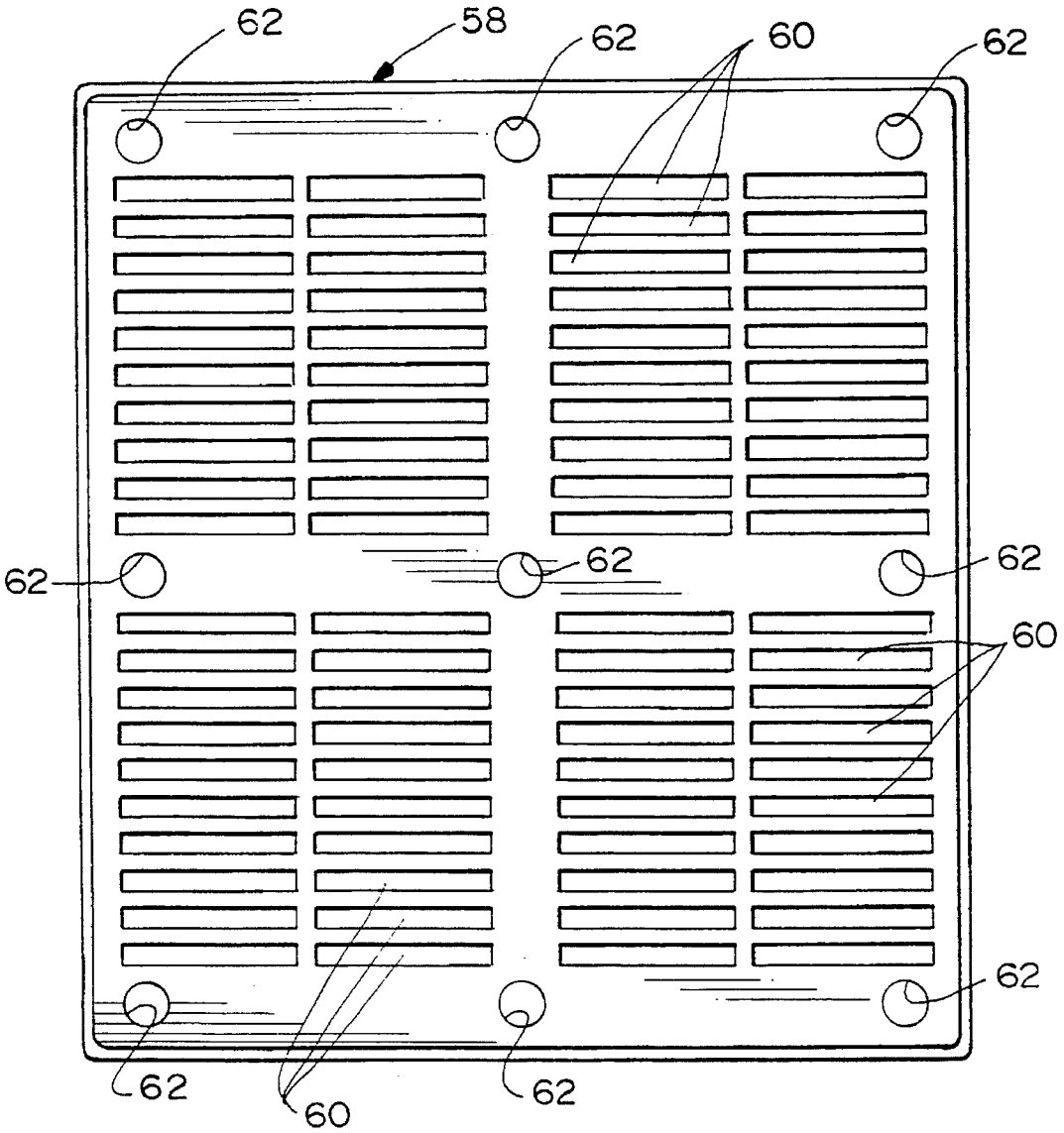
FIG. 10 is a top plan view of one of the trays used in the embodiment of FIG. 9.

Referring to the drawings in greater detail, the invention is illustrated herein in a first embodiment shown in FIGS. 1–8 and a second embodiment shown in FIGS. 9 and 10.

Figure 1:
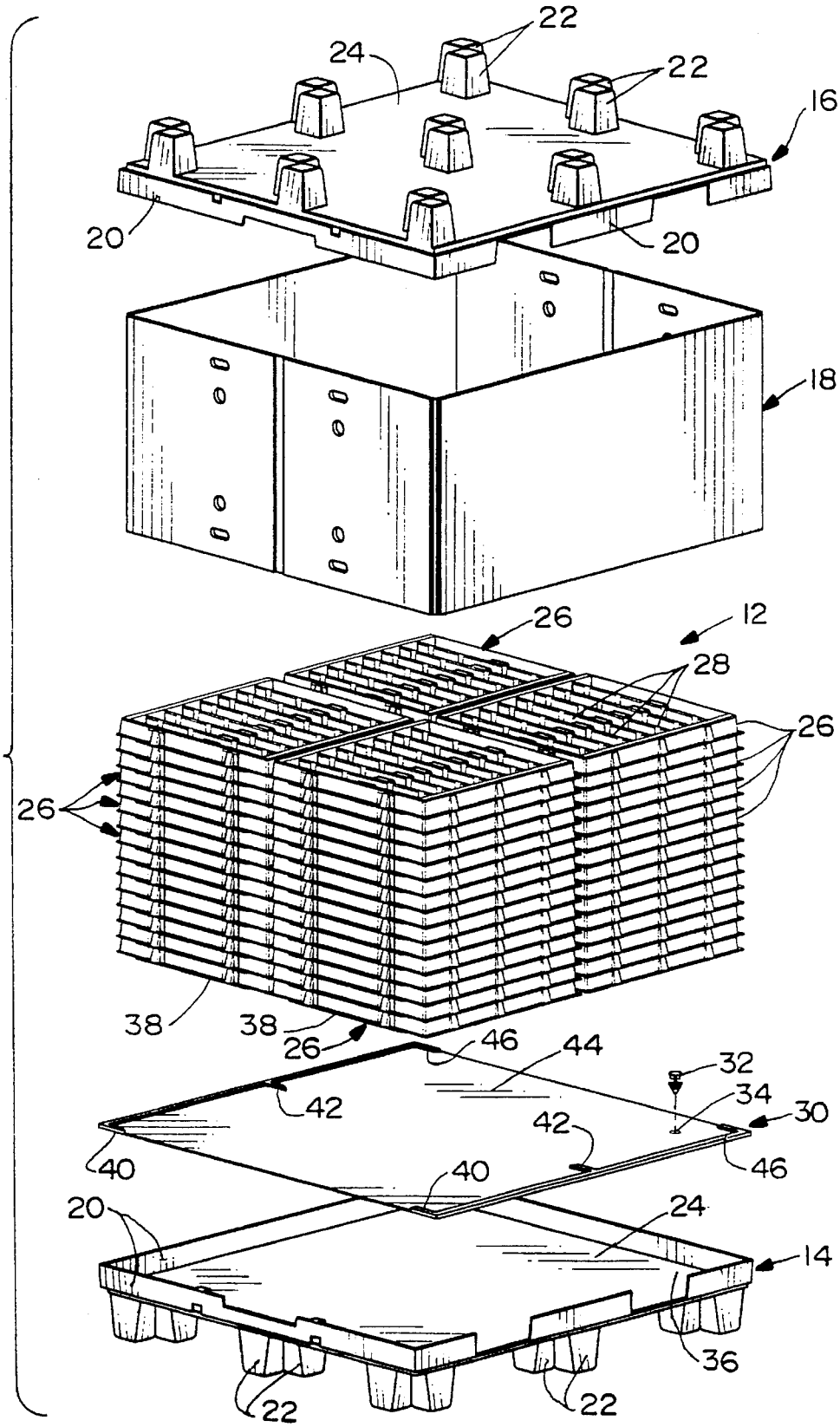
FIG. 1 is an exploded perspective view of the elements of a packaging container assembly incorporating one embodiment of the invention.
Figure 2:
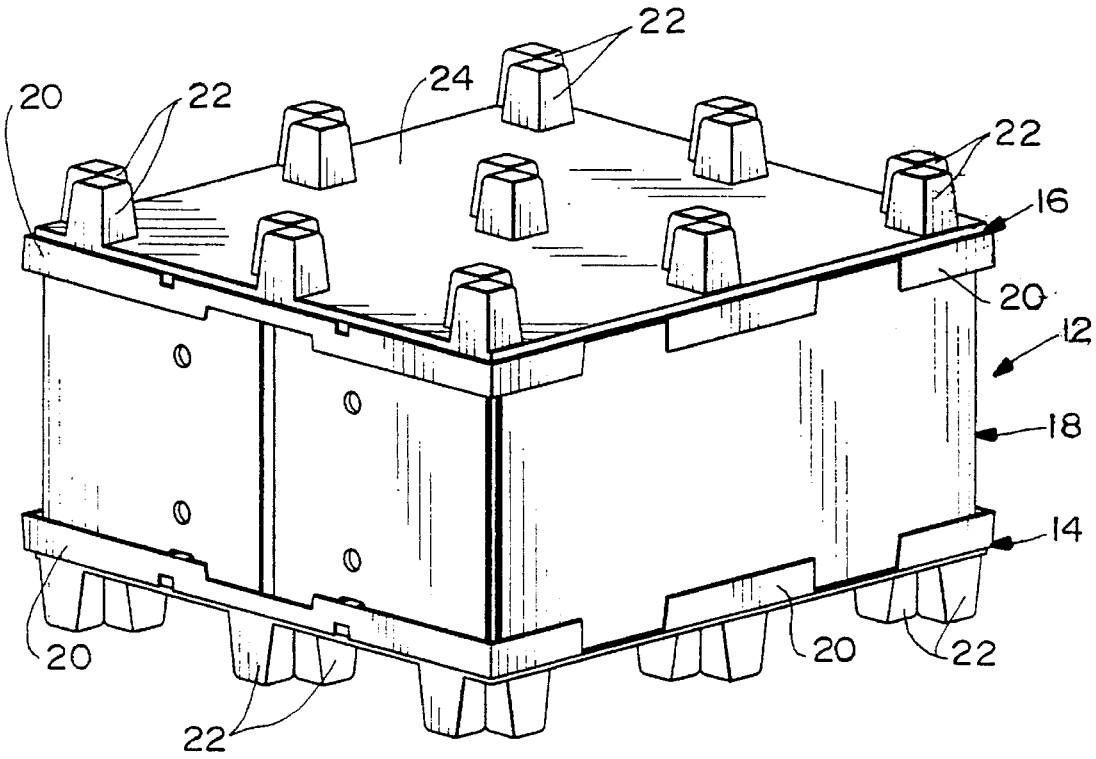
FIG. 2 is a perspective view of the packaging container assembly of FIG. 1, in assembled condition.

Referring first to FIG. 1, the invention is incorporated in a packaging container assembly, generally designated 12, which includes a bottom pallet, generally designated 14, and a top pallet, generally designated 16. The bottom and top pallets are mirror images of each other. In assembly as shown in FIG. 2, the pallets sandwich a side wall structure, generally designated 18, therebetween. The side wall structure is generally hollow and square or rectangular, and the side wall structure fits within flanges 20 about the peripheries of bottom and top pallets 14 and 16, respectively. Pairs of feet 22 project outwardly of planar wall 24 of each pallet. The feet are constructed and oriented to allow packaging container assemblies 12 to be stacked on top of each other.

Figure 3:
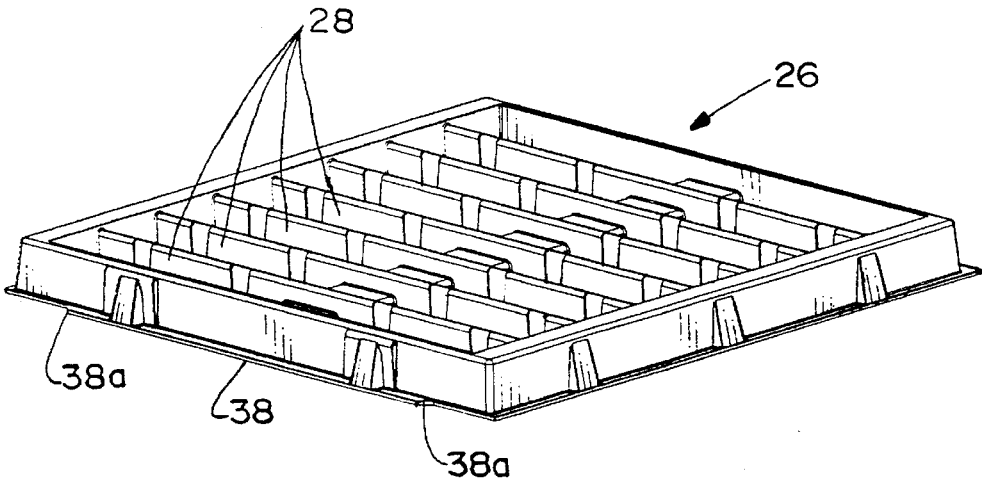
FIG. 3 is a perspective view of one of the trays for use with the assembly of FIG. 1.

In essence, packaging container assembly 12, including bottom and top pallets 14 and 16, respectively, along with side wall structure 18, defines a generally hollow container structure for containing a plurality of trays, generally designated 26, in stacked arrays of trays within the container structure. A single tray is shown in FIG. 3. However, packaging container assembly 12 is sized for receiving four stacks of trays 26 as is seen in FIG. 1. The trays may be thermal or vacuum formed of thin polyvinyl chloride or like materials.

Figure 4:
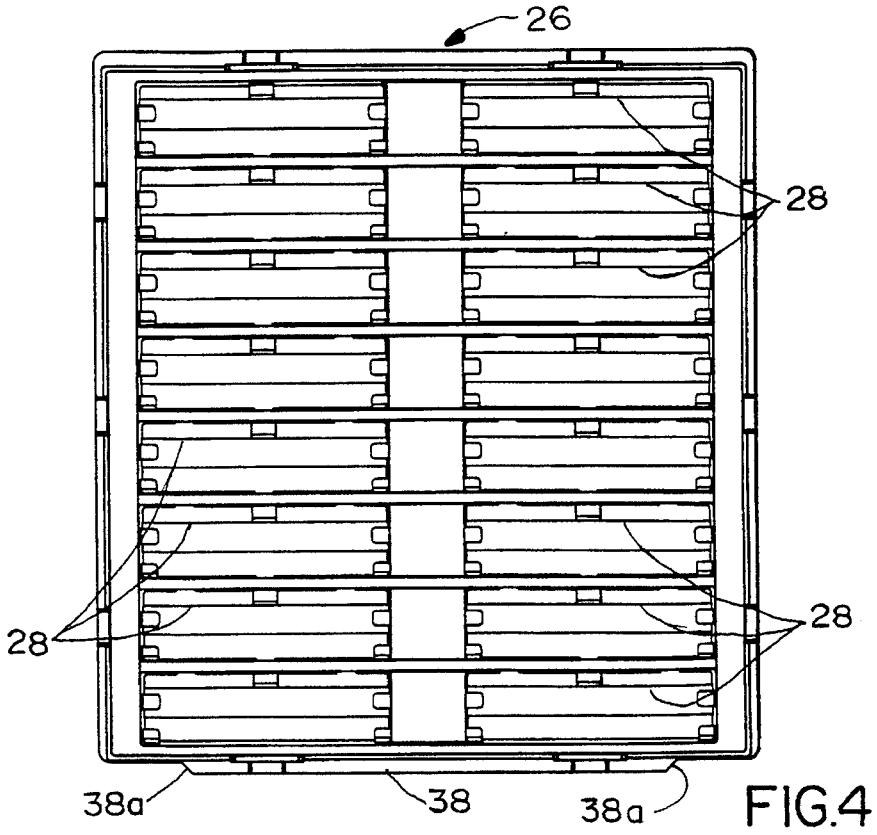
FIG. 4 is a top plan view of the tray of FIG. 3.

As best seen in FIGS. 3 and 4, each tray 26 includes a plurality of generally parallel channels or troughs 28 for received electrical connector components therewithin. The components are arranged within the individual troughs in end-to-end or side-by-side arrangements whereby the components can be fed from the tray in an orderly seriatim fashion from the troughs. In other words, the electrical connector components are arranged in the trays in a particular or given orientation which facilitates handling and/or processing procedures. For instance, it usually is desirable to feed the components to an automated machine in a specific orientation. The trays, with the components arranged in a given orientation with the tray, facilitate such processing. However, if the trays are not properly arranged in their respective packaging container assembly, assuring proper orientation of the trays and, thereby, proper orientation of the electrical connector components is time consuming and labor intensive. The present invention is directed to solving these types of orienting and/or alignment problems.

More particularly, referring to FIGS. 5–8 in conjunction with FIG. 1, packaging container assembly 12 includes a tray alignment plate, generally designated 30, which is positionable onto wall 24 of bottom pallet 14 within flanges 20 of the pallet. The four stacks of trays 26 then are positioned on top of alignment plate 30. The plate may be fixed to the pallet by a plurality of fasteners 32 (FIG. 1) projecting through apertures 34 in alignment plate 30 and apertures 36 in wall 24 of bottom pallet 14. Only one fastener 32 and its associated apertures 34 and 36 are shown in FIG. 1 in order to avoid cluttering the depiction of the drawing. Therefore, alignment plate 30 is removably mountable onto bottom pallet 14 and, correspondingly, other alignment plates for other sizes of trays can be positioned on a standard size pallet.

Figure 6:
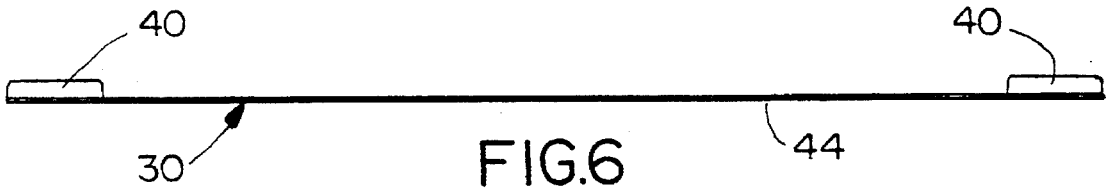
FIG. 6 is a front elevational view of the alignment plate of FIG. 5.

Generally, the invention contemplates the provision of complementary interengaging alignment means between a tray 26 and alignment plate 30 for assuring proper alignment of the tray relative to the alignment plate and, thereby, assuring proper orientation of the electrical connector components within packaging container assembly 12. More particularly, as seen best in FIG. 4, each tray 26 includes a flange 38 projecting outwardly from one side of the tray. The ends of the flange are tapered or angled, as at 38*a*. Alignment plate 30 includes alignment ribs 40 at two corners thereof and alignment ribs 42 along opposite sides of the plate. The alignment plate basically includes a sheet-like body 44 and alignment ribs 40 and 42 project upwardly therefrom as best seen in FIG. 6. Blocking ribs 46 are formed at the end of alignment plate 30 opposite alignment ribs 40, for purposes to be described hereinafter.

Figure 5:
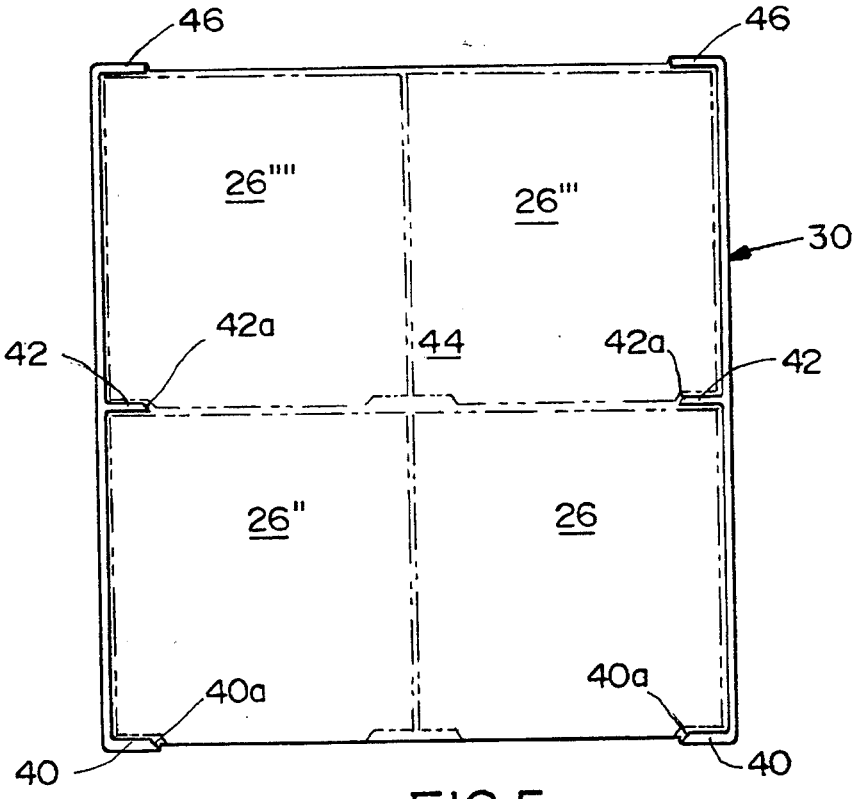
FIG. 5 is a top plan view of the tray alignment plate for use with the assembly of FIG. 1.
Figure 7:
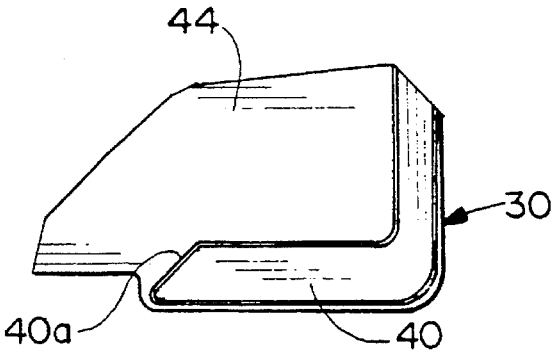
FIG. 7 is an enlarged fragmented view of the alignment rib at the bottom right-hand corner of the tray in FIG. 5.

FIG. 7 is an enlarged depiction of the alignment rib 40 at the bottom right-hand corner of alignment plate 30 as depicted in FIG. 5. It can be seen that the alignment rib has an angled distal end 40*a*. This angled end is adapted for interengagement with the right-hand angled end 38*a* of flange 38 of one of the trays 26. The alignment rib 40 at the bottom left-hand corner of alignment plate 30 in FIG. 5 also has an angled end 40*a* but at an angle opposite to that shown in FIG. 7, for interengagement with the left-hand angled end 38*a* of flange 38 of one of the trays 26.

FIG. 8 shows the right-hand alignment rib 42 of alignment plate 30 as viewed in FIG. 5. It can be seen that alignment rib 42 has an angled end 42*a* similar to and at the same angle as end 40*a* of alignment rib 40 in FIG. 7. Angled end 42*a* of alignment rib 42 is adapted for interengagement with the right-hand angled end 38*a* of flange 30 of one of the trays 26. Similarly, the left-hand alignment rib 42 in FIG. 5 has an angled end 42*a* which is opposite the angle of end 42*a* of rib 42 in FIG. 8, whereby the angled end of the left-hand rib 42 is adapted for interengagement with the left-hand end 38*a* of flange 38 of one of the trays 26.

Lastly, blocking ribs 46 (FIG. 5) are not provided with any angled ends such as angled ends 40*a* of alignment ribs 40 or angled ends 42*a* of alignment ribs 42. In essence, blocking ribs 46 project inwardly at least to the same extent as alignment ribs 40 or 42, but blocking ribs 46 have blunt ends which, by their shape, cannot interengage with angled ends 38*a* of flanges 38 of trays 26. Therefore, the trays cannot be oriented such that flanges 38 of the trays project laterally outwardly between blocking ribs 46.

With the above description of alignment ribs 40 and 42, along with their angled ends 40*a* and 42*a*, reference is made to FIG. 5 wherein four trays 26', 26", 26''' and 26'''' are shown in phantom. The four trays represent the four stacks of trays shown in FIG. 1. The four trays are positionable in quadrants of alignment plate 30. Tray 26' is shown positioned in the bottom right-hand quadrant of tray 30 in FIG. 5. That tray 26' can only be positioned in that quadrant in an orientation whereby the right-hand angled corner 38*a* of flange 38 (FIG. 4) is interengaged with angled end 40*a* of the alignment rib 40 at the bottom right-hand corner of the alignment plate. Similarly, tray 26" can be positioned in the bottom left-hand quadrant of the tray only in an orientation whereby the left-hand end 38*a* of its flange 38 interengages with angled end 40*a* of the alignment rib 40 at the bottom left-hand corner of the tray. Tray 26''' can be positioned in the upper right-hand quadrant of tray 30 only in an orientation wherein the right-hand angled end 38*a* of its flange 38 interengages with angled end 42*a* of the right-hand alignment rib 42. Lastly and similarly, tray 26'''' can be positioned in the upper left-hand quadrant of alignment plate 30 only in an orientation wherein the left-hand angled end 38*a* of its flange 38 interengages with angled end 42*a* of the left-hand alignment rib 42.

From the foregoing, it can be understood that trays 26 can be positioned in the four quadrants of the alignment plate 30 only in specific orientations. Of course, by specifically orienting the trays, the electrical connector components within the trays also are specifically oriented within packaging container 12. Therefore, if the container is delivered, stacked or oriented in a given orientation, the small electrical connector components will be assured of being in a given orientation corresponding to the container orientation.

At this point, it should be understood that the terms "electrical connector components" as used herein and in the claims hereof are intended to include the components of any particular electrical connector assembly as well as the electrical connectors themselves which may be positioned and properly oriented within a tray of the packaging container assembly.

FIGS. 9 and 10 show an alternate embodiment of a packaging container assembly, generally designated 12', similar to container assembly 12 (FIG. 1) except for the configuration of the tray alignment plate thereof and the trays contained within the container. Therefore, like reference numerals have been applied in FIG. 9 corresponding to like components described above in relation to packaging container assembly 12 of FIG. 1.

In particular, container assembly 12' includes an alignment plate, generally designated 50, which includes a plurality of pairs of alignment slots 52 in a sheet-like body 54 of the alignment plate. It can be seen in FIG. 9 that the alignment slots are elongated and in generally parallel sets thereof. Nine stacks 56 of trays 58 are positionable on top of alignment plate 50 which, in turn, is nested within upstanding flanges 20 of bottom pallet 14. Again, fasteners 32 may be employed to removably mount alignment plate 50 onto wall 24 of pallet 14.

Each tray 58 in the embodiment of FIGS. 9 and 10 includes a plurality of channels or troughs 60 for receiving electrical connector components in a specific or given orientation. Like tray 26, tray 58 can be thermal or vacuum formed of thin polyvinyl chloride or like materials. In order to assure proper orientation of trays 58 on alignment plate 50, each tray is formed with a plurality of projecting alignment feet 62 which are adapted for positioning in alignment slots 52 of alignment plate 50. Whereas the complementary interengaging alignment means in the embodiment of FIGS. 1–8 restricts the orientation of any given tray 26 to a single direction whereby the respective flange 38 of the tray points in a given direction, the alignment means provided by alignment feet 62 and alignment slots 52 in the embodiment of FIGS. 9 and 10 allows the tray to be positioned on the alignment plate in either of two opposite orientations. In other words, generally parallel alignment slots 52 are "open ended" to allow the trays to be positioned thereon in either of two opposite orientations. Such an arrangement as in FIGS. 9 and 10 can accommodate electrical connector components, such as a simple elongated ferrite block, which can be assembled within an electrical connector in either of two opposite orientations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A packaging container assembly for electrical connector components, comprising:

a pallet;

a tray alignment plate positionable onto the pallet;

at least one tray positionable onto the alignment plate and including means for supporting electrical connector components in a given orientation;

complementary interengaging alignment means between the tray and the alignment plate for assuring proper alignment of the tray relative to the alignment plate and, thereby, assuring proper orientation of the electrical connector components within the assembly; and wherein said alignment means comprise at least one set of generally parallel elongated slots, and the alignment means on the tray comprise means for positioning within the slot.

2. The packaging container assembly of claim 1 wherein said tray alignment plate comprises a sheet-like member, and said alignment means comprise raised rib means on the sheet-like member for engaging complementary alignment means on the tray only when the tray is properly aligned.

3. The packaging container assembly of claim 2 wherein said rib means is located at an edge of the sheet-like member, and the alignment means on the tray is located at the periphery thereof.

4. A packaging container assembly for electrical connector components, comprising:

a pallet;

a tray alignment plate positionable onto the pallet;

at least one tray positionable onto the alignment plate and including means for supporting electrical connector components in a given orientation;

complementary interengaging alignment means between the tray and the alignment plate for assuring proper alignment of the tray relative to the alignment plate and, thereby, assuring proper orientation of the electrical connector components within the assembly, wherein said pallet includes a generally planar top wall, and said tray alignment plate comprises a sheet-like member for positioning onto the top wall; and wherein said alignment means include slots in the sheet-like member.

5. The packaging container assembly of claim 4 wherein said alignment means include raised means on the sheet-like member.

6. The packaging container assembly of claim 5 wherein said alignment means comprise raised rib means on the sheet-like member for engaging complementary alignment means on the tray only when the tray is properly aligned.

7. The packaging container assembly of claim 6 wherein said rib means is located at an edge of the sheet-like member, and the alignment means on the tray is located at the periphery thereof.

* * * * *